US007891286B2

(12) United States Patent
Scarchilli et al.

(10) Patent No.: US 7,891,286 B2
(45) Date of Patent: Feb. 22, 2011

(54) LIQUID INFUSION PODS CONTAINING INSOLUBLE MATERIALS

(75) Inventors: John Joseph Scarchilli, Cincinnati, OH (US); James Earl Trout, West Chester, OH (US); Roger William Gutwein, Cincinnati, OH (US); Robert George Cox, Jr., Cincinnati, OH (US); Matthew David Fitts, Fairfield, OH (US); Michael Jerome Picca, Cincinnati, OH (US); Stephen Jerome Westerkamp, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 867 days.

(21) Appl. No.: 11/827,535

(22) Filed: Jul. 12, 2007

(65) Prior Publication Data

US 2007/0259074 A1 Nov. 8, 2007

Related U.S. Application Data

(63) Continuation of application No. 10/792,149, filed on Mar. 3, 2004, now abandoned.

(60) Provisional application No. 60/451,513, filed on Mar. 3, 2003.

(51) Int. Cl.
*B65B 29/02* (2006.01)
*A47J 31/00* (2006.01)

(52) U.S. Cl. ..... 99/295; 99/323

(58) Field of Classification Search ..... 99/295, 99/323; 426/77, 78, 79, 80, 81, 82
See application file for complete search history.

(56) References Cited

U.S. PATENT DOCUMENTS

| | | | | |
|---|---|---|---|---|
| 1,377,316 | A | | 5/1921 | Clermont |
| 2,469,553 | A | | 5/1949 | Hall |
| 2,589,783 | A | * | 3/1952 | Crossley et al. ..... 99/295 |
| 2,750,998 | A | | 6/1956 | Moore |
| 2,771,343 | A | | 11/1956 | Chase et al. |
| 2,778,739 | A | | 1/1957 | Rodth |
| 2,926,594 | A | | 3/1960 | Werner et al. |
| 2,978,446 | A | | 4/1961 | Batista et al. |
| 3,023,104 | A | | 2/1962 | Batista et al. |
| 3,141,875 | A | | 7/1964 | Batista et al. |
| 3,436,227 | A | | 4/1969 | Bergeron et al. |
| 3,493,388 | A | | 2/1970 | Hair |
| 3,615,669 | A | | 10/1971 | Hair et al. |
| 3,620,756 | A | | 11/1971 | Strobel et al. |
| 3,652,293 | A | | 3/1972 | Lombana et al. |

(Continued)

FOREIGN PATENT DOCUMENTS

| | | |
|---|---|---|
| EP | 168112 | 1/1986 |

*Primary Examiner*—Reginald L Alexander
(74) *Attorney, Agent, or Firm*—Adam W. Borgman; Kim William Zerby

(57) ABSTRACT

A liquid infusion pod having a fluid distribution member and a liquid permeable first filter member. The filter member is sealed to the fluid distribution member forming a first interior chamber that contains a liquid dispersible material. The fluid distribution member has at least one injection nozzle protruding downward from the top of the fluid distribution member into the interior chamber. The injection nozzle has at least one infusion port that directs fluid into the first interior chamber in a direction that is not normal to the top plane of the fluid distribution member.

20 Claims, 10 Drawing Sheets

U.S. PATENT DOCUMENTS

| | | | |
|---|---|---|---|
| 3,985,069 | A | 10/1976 | Cavalluzzi |
| 4,338,346 | A | 7/1982 | Brand et al. |
| 4,399,163 | A | 8/1983 | Brennan et al. |
| 4,411,925 | A | 10/1983 | Brennan et al. |
| 4,423,029 | A | 12/1983 | Rizzi |
| 4,734,287 | A | 3/1988 | Singer et al. |
| 4,911,946 | A | 3/1990 | Singer et al. |
| 4,961,953 | A | 10/1990 | Singer et al. |
| 5,153,020 | A | 10/1992 | Singer et al. |
| 5,390,587 | A | 2/1995 | Wu |
| 5,567,461 | A | 10/1996 | Lehrer |
| 5,906,844 | A * | 5/1999 | Stahli et al. ..... 426/77 |
| 6,605,311 | B2 | 8/2003 | Villagran et al. |
| 6,658,989 | B2 | 12/2003 | Sweeney et al. |
| 6,740,345 | B2 | 5/2004 | Cai |
| 6,758,130 | B2 | 7/2004 | Sargent et al. |
| 6,777,007 | B2 | 8/2004 | Cai |
| 2002/0061354 | A1 | 5/2002 | Lin et al. |
| 2002/0155209 | A1 | 10/2002 | Hardesty et al. |
| 2003/0172813 | A1 | 9/2003 | Schifferle |

* cited by examiner

LIQUID INFUSION PODS CONTAINING INSOLUBLE MATERIALS

CROSS REFERENCE TO RELATED APPLICATIONS

Pursuant to 35 U.S.C. §120, this application is a continuation of U.S. application Ser. No. 10/792,149, which was filed on Mar. 3, 2004, now abandoned and also claims the benefit of priority to U.S. Provisional Application Ser. No. 60/451,513, filed Mar. 3, 2003, which are herein incorporated by reference.

BRIEF DESCRIPTION OF THE INVENTION

The present invention relates to self-contained, pre-dosed infusion pods that comprise at least some water insoluble materials. Powdered dairy and non-dairy creamer compositions are non-limiting examples of the materials that can be delivered from the infusion pods of this invention. The pods of the present invention are especially useful for brewing creamy, coffee based beverages.

BACKGROUND OF THE INVENTION

Making coffee is a time consuming and work intensive operation. The typical coffee drinker uses a brew basket type coffee machine that requires the following process steps. The coffee pot must be rinsed and filled with clean water, the grounds used to brew the previous pot of coffee must be removed from the basket and the brew basket rinsed. Then a new filter is placed in the basket and grounds are measured and placed in the filter. This, of course, assumes that the consumer buys pre-ground coffee rather than grinding their own beans. The grounds that inevitably spill onto the counter top must be cleaned, and then the water is poured into the brewer's reservoir. The machine is turned on, and then the consumer waits. And waits. And then waits some more while the pot brews.

Often this lengthy and laborious process is carried out when the consumer wants only a single cup of coffee. Moreover, at the end of the brewing process the consumer has black coffee. Cream and sugar must be measured and added if that is how the consumer drinks their coffee.

There are options available for coffee drinkers that address the problems associated with coffee brewing, but with marginal success. For example, a single cup of coffee can be brewed with a standard brew basket brewer. But because these machines are designed for 4, 8, 10 or more cups, brewing one cup is sub-optimal and often results in wasting grounds and problems with strength control. Moreover, all of the process steps described above must be followed whether making one cup or ten. Espresso machines are another option for preparing single cup servings of a coffee like beverage. But the cleaning and filling of and espresso machine's brewing cartridge can be time consuming and messy. Espresso grounds are quite fine and need to be tightly packed. Because of the tight packing and because espresso machines brew with steam, the grounds are often difficult to remove from the cartridge when they are wet. Moreover, espresso is a concentrated form of coffee that is too strong for the tastes of many consumers, and espresso grounds are often more expensive than regular grounds. The addition of frothy cream to an espresso beverage involves a separate steam line and a separate pot of milk or cream and more work for the consumer preparing the froth and cleaning up afterwards. At the end of it all, the consumer has a delicious espresso beverage, but only after the expenditure of considerable time, energy and cost.

Finally, there is the option of visiting the local coffee house. These establishments—in general—provide an excellent cup of coffee, espresso, latte, etc., without any work on behalf of the consumer. But there is still a great deal of work that goes into the production of these beverages, and that work is included in the price. Moreover, visiting the local coffee house necessarily involves leaving your home or office or wherever it is that you wish to drink your beverage, and going somewhere else to get a cup of coffee. Currently, there are no options that allow the consumer to reduce the number of steps necessary to brew a single cup of coffee with a frothy, creamy head, do it at home or at work, and do it at a cost similar to the cost of brewing coffee at home.

Pre-dosed packets of coffee grounds in filter pods are available to simplify the coffee brewing process. But these packets are typically designed for the multi-cup brew basket coffee brewers. Thus, they are not amenable to single cup brewing. Recently, however, single cup brew pods have been introduced with a special single cup brewing machine. While these machines and their pods eliminate some of the work and mess associated with brewing a single cup of coffee, they still brew black coffee only. Thus, at best, these new machines solve only half of the problems.

Attempts have been made to supply filter pods containing sweetener and creamer ingredients. Unfortunately, these attempts have largely failed due to the difference in the type of ingredients. More specifically, coffee is brewed through a standard extraction process. Hot water, steam or both are fed onto the grounds and the coffee is extracted. Coffee flows through the filter medium leaving the spent, wet grounds behind. In general, neither the coffee nor the grounds clog the filter media.

The coffee extraction process stands in sharp contrast to the process of fluidizing a solid, granular or concentrated liquid dispersible material. Liquid dispersible materials typically include fats, oils, proteins and combinations of these ingredients that are either not water soluble or not readily soluble in water. Often this fluidization process is described as "dissolving" the creamer, but this is a misnomer because many of the creamer ingredients do not dissolve in water but are instead suspended or emulsified in water. Regardless, the presence of insoluble, or slightly soluble ingredients presents a substantial problem when trying to deliver liquid dispersible materials in a pre-dosed, self-contained filter pod.

FIG. 11 illustrates the problem associated with prior attempts to make a creamer extraction pod 130. Specifically, as liquid 14 is showered down from the top—as is the case in substantially all coffee makers—through filter 122, the liquid dispersible material, illustrated as liquid dispersable material 18, is forced downward forming a packed layer 19 on bottom filter 23. Packed layer 19 clogs bottom filter 23 restricting the flow of liquid 14. Eventually, channels 21 begin to form as cracks in packed layer 19, allowing extracted liquid 115 to escape extraction pod 130. The problem is that packed layer 19 contains a substantial quantity of virgin or unextracted liquid dispersible material 18. And because extracted liquid 115 escapes through channels 21, it does not make sufficient contact with the liquid dispersible material 18 and the concentration of dispersible materials in extracted liquid 115 is likely to be well below the desired level. Moreover, channels 21 can form in a variety of places and directions. Thus, extracted liquid 115 can be forced out of the sides or top of extraction pod 130 causing additional problems, not to mention generally making a mess of the inside of the coffee brewer. Ultimately, extraction pod 130 does not work when it is filled with materials that are slightly soluble, or are water insoluble.

As such, there exists a need for a liquid infusion pod that overcomes the problems discussed above. It should be pre-dosed and self-contained to provide the consumer with a quick and convenient way to prepare a hot infusion beverage. The spent pod should be easily removed and disposed of leaving minimal mess in the beverage making machine. The material in the pod should be substantially used, that is, the spent pod should be mostly empty when disposed of. Finally, the infusion pod should be designed so that the filter does not clog. These and many other problems are solved by the infusion pods of the present invention.

SUMMARY OF THE INVENTION

There is provided herein a liquid infusion pod comprising a fluid distribution member situated in a top plane and a liquid permeable first filter member. The first filter member is sealed to the fluid distribution member forming a first interior chamber that comprises a liquid dispersible material. The fluid distribution member comprises at least one injection nozzle protruding downward from the top plane into the interior chamber. The injection nozzle has at least one infusion port that directs fluid into the first interior chamber in a direction that is not normal to the top plane.

In one aspect of the present invention the liquid infusion pod comprises a fluid distribution member comprising at least one injection nozzle having a first position that is substantially flush with the top plane. The injection nozzle has a second position wherein it is protruding downward from the top plane into the first interior chamber. The injection nozzle in this embodiment has at least one infusion port that is open when in the second position and the infusion port directs fluid into the interior chamber in a direction that is not normal to the top plane.

In yet another aspect of the present invention, the liquid infusion pod comprises a fluid distribution member situated in a top plane and a liquid permeable first filter member that is releaseably attached to the liquid distribution member. The first filter member and the fluid distribution member form a first interior chamber and within the first interior chamber is a self contained, pre-dosed filter pod having a second interior chamber comprising a liquid dispersible material. The fluid distribution member comprising at least one injection nozzle protruding downward from the top plane into the first interior chamber without piercing the pre-dosed filter pod. The injection nozzle having at least one infusion port that directs fluid into the second interior chamber in a direction that is not normal to the top plane.

In another aspect of this invention there is provided a liquid infusion pod comprising a fluid distribution member situated in a top plane and a liquid permeable first filter member. The filter member is sealed to the fluid distribution member forming a first interior chamber that comprises a liquid dispersible material. The fluid distribution member comprises at least one injection nozzle protruding downward from the top plane into the first interior chamber, and the injection nozzle has at least one infusion port and at least one deflection plate. When liquid flows through the infusion port it is directed onto the deflection plate such that the fluid deflects off of the deflection plate into the first interior chamber in a direction that is not normal to the top plane.

In a preferred aspect of the present invention any one of the infusion pods described herein can further comprise an extraction pod situated above the liquid infusion pod with respect to the flow of the liquid through the pods. The extraction pod comprises a second filter member defining a second interior chamber that comprises an extractable material. Likewise, in all of the infusion pods described herein, the liquid dispersible material is preferably substantially dry and comprises at least one of a fat containing material, a protein containing material and mixtures thereof.

The present infusion pods provide many improvements over the prior art. The most important of which is more efficient use and delivery of the liquid dispersible materials contained therein. The present infusion pods avoid clogging of the filter medium and most if not all of the liquid dispersible material is delivered to the beverage. In all embodiments of the present invention the infusion liquid is directed into the pod below the top plane and ultimately in a direction not normal to the top plane or in a direction opposite the initial flow of the infusion liquid. This fluidizes the liquid dispersible material, creates turbulence and keeps the dispersible materials from forming a packed layer and clogging the bottom of the filter. All of these benefits combine to produce a better process of liquefying and delivering ingredients that are only slightly soluble in water.

The present pods can be used to deliver sweetener, cream and frothy toppings to any extracted beverage, such as tea or coffee, and they can be used to deliver other beverages such as hot cocoa. Likewise, non-fat creamers can be delivered with these pods as they typically contain proteinatious matter that can clog filter medium. Ultimately, the mechanical design of the pods defined herein, provides superior fluid flow characteristics and better delivery of liquid dispersible materials. Thus, the consumer is provided with a self-contained, pre-dosed infusion pod that reduces the amount of work that goes into brewing a cup of coffee or similar beverages. The resulting beverage is as good as those produced at a coffee house, but at a substantially reduced cost and without the need to travel to a different location to acquire the beverage of one's choice. Moreover, the brewing process is much faster than prior processes due to the improved fluid dynamics.

BRIEF DESCRIPTION OF THE DRAWINGS

While the present application concludes with claims that distinctly define the present invention, it is believed that this invention will be better understood with reference to the drawings wherein:

DETAILED DESCRIPTION OF THE INVENTION

Liquid Infusion Pods

The present invention is directed to infusion pods that comprise a liquid dispersible material. More specifically, there is provided herein a liquid infusion pod comprising a fluid distribution member situated in a top plane and a liquid permeable first filter member. The first filter member is sealed to the fluid distribution member forming a first interior chamber that comprises a liquid dispersible material. The fluid distribution member comprises at least one injection nozzle protruding downward from the top plane into the interior chamber. The injection nozzle has at least one infusion port that directs fluid into the first interior chamber in a direction that is not normal to the top plane.

Figure 1:
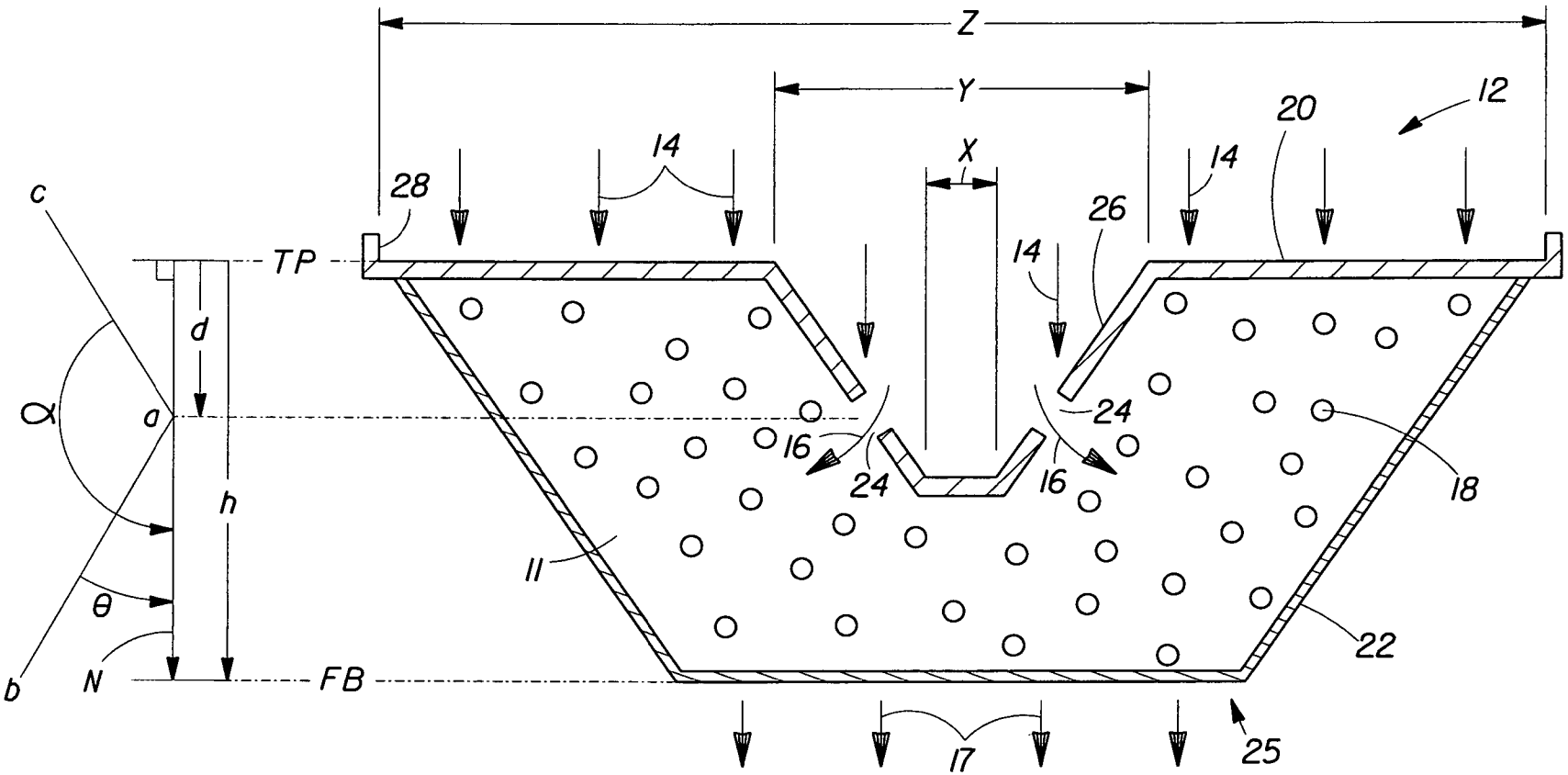
FIG. 1 is a cross sectional view of an infusion pod according to the present invention.

Referring now to FIG. 1 which shows liquid infusion pod 12 that comprises fluid distribution member 20 and first filter member 22 which are sealed to define first interior chamber 11. Fluid distribution member 20 comprises injection nozzle 26 and may optionally comprise end wall 28. Injection nozzle 26 comprises infusion ports 24. While two infusion ports 24 are shown in FIG. 1 it is understood that one infusion port is sufficient, likewise, three or more infusion ports can be used. The criticality of the infusion ports is best described in conjunction with the use of infusion pod 12.

Fresh liquid 14 is introduced to fluid distribution member 20 and it flows either by gravity or by an applied pressure, toward injection nozzle 26. Fresh liquid 14 collects in injection nozzle 26 and is forced through infusion ports 24, again, either due to gravity of by externally applied pressure. The size and number of infusion ports 24 must be designed such that when fresh liquid 14 flows through the infusion ports 24 is has a relatively high fluid momentum, shown in FIG. 1 as high momentum liquid 16, and it is directed away from filter bottom FB. Thus, infusion ports must be designed, in size and number, to insure that the liquid entering the first interior chamber 11 does not pack the liquid dispersible material 18, but rather fluidizes it. The fluidization is accomplished by the combination of having a relatively high momentum fluid 16 that enters the pod in a direction that is not normal N to the top plane TP of infusion pod 12.

More specifically, as shown in FIG. 1, infusion pod 12 has a top plane TP and a filter bottom FB. Normal line N is shown normal, that is 90°, from top plane TP. By "not normal" to top plane TP it is meant that infusion port 24 delivers high momentum liquid 16 to first interior chamber 11 at an angle from about 20° to about 160°, preferably from about 30° to about 150°, and more preferably from about 40° to about 140° from the point of the infusion port on a line normal to the top plane. These angles are illustrated on FIG. 1 as angles $\alpha$ and $\theta$, wherein angle $\alpha$ is the arc swung by line ac from normal N, and wherein angle $\theta$ is the arc swung by line ab from normal N.

Distance d is the distance that infusion port 24 is below top plane TP measured along normal N. Likewise, h is the height of infusion pod 12 measured along normal N from top plane TP to filter bottom FB, and penetration p is the distance that injection nozzle 26 penetrates into first interior chamber 11 measured down from top plane TP along normal N. Height h is preferably from about 1.0 cm to about 10 cm, more preferably from about 1.5 cm to about 7.5 cm and most preferably from about 1.8 cm to about 5 cm. Penetration p is preferably at least about 20%, more preferably at least about 25% and most preferably at least about 30% of height h. Penetration p can, and preferably does, extend 100% of height h. Necessarily, distance d is always less than or equal to penetration p and d is preferably at least about 20%, more preferably at least about 25% and most preferably at least about 30% of height h. Distance d can extend 100% of height h, but preferably d extends less than about 98%, more preferably less than about 96%, and even more preferably, less than about 94% of height h.

Also shown in FIG. 1 is diameter Z, the width of infusion pod 12, diameter Y, the width of injection nozzle liquid opening 25, and diameter X, the width of injection nozzle bottom 27. While X, Y and Z are described as "diameters", infusion pod 12 need not be round. In fact any geometric shape is acceptable. If infusion pod 12 is round then Z is the diameter of the top surface area of the pod, if the pod is square, then Z is the length of any edge of the square, if the pod is rectangular or elliptical then Z is the average of the major and minor dimensions. Those skilled in the art will understand how to calculate a "diameter" for the various appropriate geometries. Preferably Z is from about 2.0 cm to about 20 cm, more preferably from about 2.5 cm to about 15 cm and most preferably from about 3.0 cm to about 10 cm.

Depending on the geometry, X, Y and Z can be used to determine the three applicable surface areas. Y is preferably sized so that the surface area of the injection nozzle liquid opening is from about 2% to about 50% of the total surface area of liquid distribution member, as calculated with Z. Diameter X can be 0 cm, and it is preferably less than or approximately equal to Y. However, there is no technical reason that X cannot be larger than Y.

Figure 11:
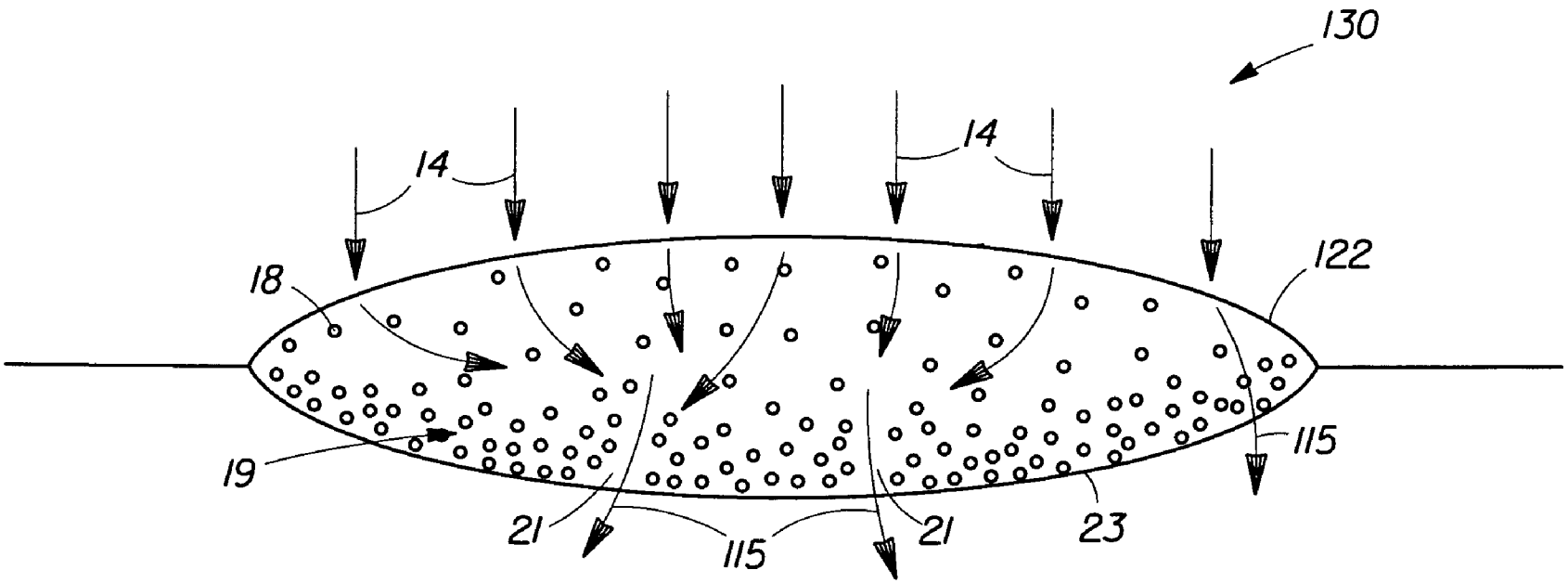
Fig. 11 Prior Art
FIG. 11 is a cross sectional view of an extraction pod of the prior art that contains a liquid dispersible material.

Returning now to high momentum fluid 16, it is understood that the momentum of a fluid is the product of the fluids velocity and its mass. And it is truly the fluid's momentum that fluidizes the liquid dispersible materials and prevents packing and caking of these materials that results in clogging of the bottom filter, see for example FIG. 11. Since fluidization of the liquid dispersible materials provides the desired benefit, it is preferred that the liquid enters the interior chamber at a relatively high momentum. Those skilled in the art will appreciate that "high" momentum is a relative term and will vary with the size and design of the pod. But it is equally understood that a high linear fluid velocity, with a very small mass flow rate may not be sufficient to fluidize the liquid dispersible materials within the pod. Likewise, a high mass flow rate and very low linear velocity may not sufficiently fluidize the liquid dispersible materials. Thus, the momentum of the fluid entering the interior chamber must be considered when designing the size of the infusion ports, and the number of ports. Those skilled in the art will be able to determine the appropriate momentum based on the desired flow rate of liquid through the infusion pod. In general, however, it is preferred that the infusion port be small enough that water will flow through it with a linear velocity of at least about 25 cm/second under a pressure of about 1.5 atmospheres or more.

Figure 2:
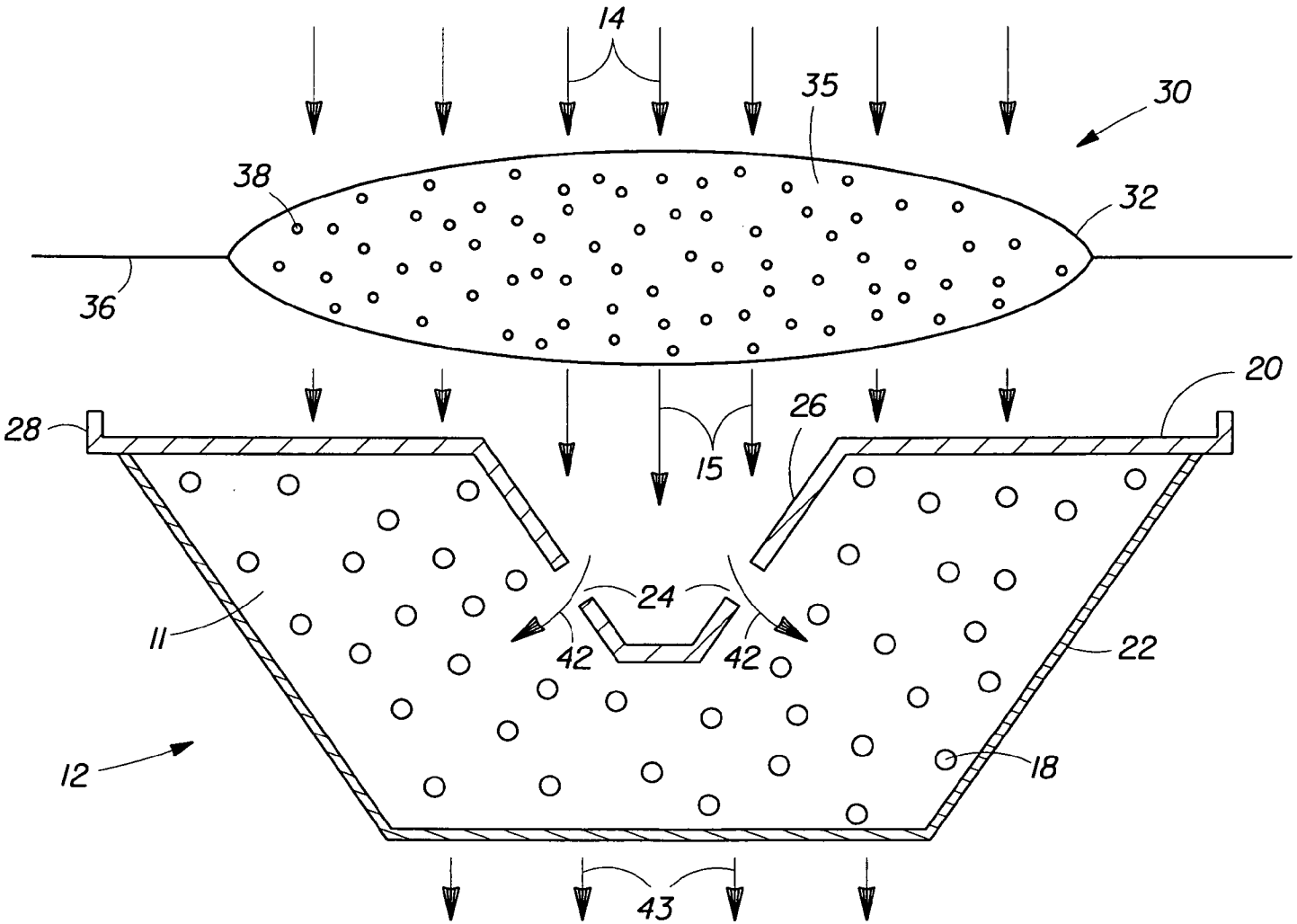
FIG. 2 is a cross sectional view of the infusion pod of FIG. 1 further comprising an extraction pod.

Turning now to FIG. 2 which shows the infusion pod 12 of FIG. 1 further comprising an extraction pod 30 situated above infusion pod 12 with respect to the flow of fresh liquid 14 through the two pods. Extraction pod 30 comprises a second filter member 32 which is sealed along filter edges 36 defining a second interior chamber, or extraction chamber 35. Extraction chamber 35 comprises an extractable material 38.

Figure 3:
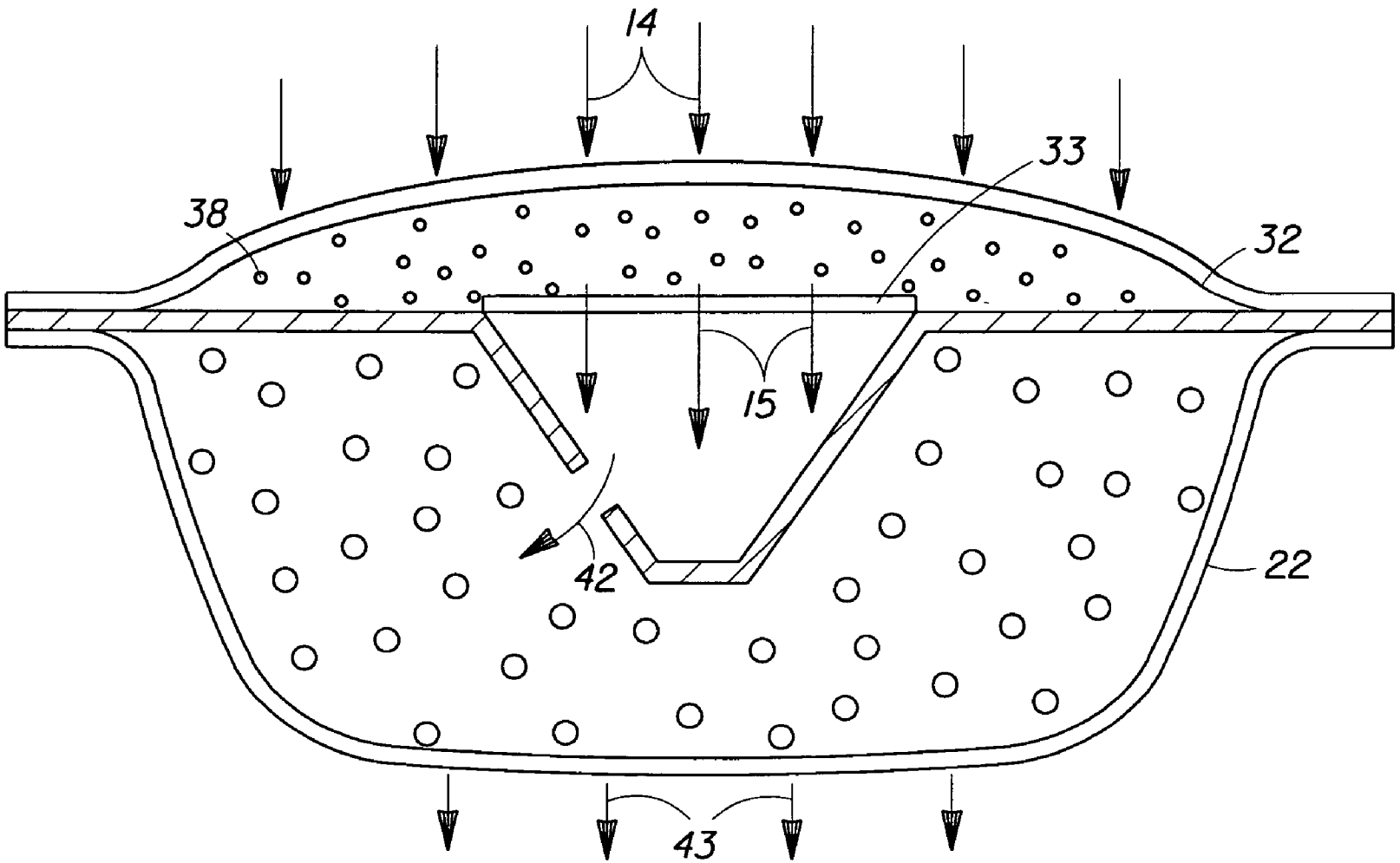
FIG. 3 is a cross sectional view of a unitary infusion pod of the present invention that comprises both an extraction pod and an infusion pod and only one infusion port.

As can be seen, fresh liquid 14 flows through extraction pod 30 and exits as extracted liquid 15, which is collected on fluid distribution member 20. Extracted liquid 15 flows into injection nozzle 26 and is fed into infusion ports 24 as high momentum extracted liquid 42. After fluidizing and contacting liquid dispersible material 18 within first interior chamber 11, the liquid exits filter member 22 as post extraction and post infusion liquid 43. FIG. 3 illustrates a variation of the dual pod design of FIG. 1 wherein the second filter member 32 is sealed to the fluid distribution member forming one pod that contains both an extractable material 38 and a liquid dispersible material 18. Note that injection nozzle filter member 33 has been added to insure that extractable material 38 does not fill and clog injection nozzle 26. Note also, that only one infusion port 24 is shown in this embodiment. As discussed above, the number and size of infusion ports can be determined by those skilled in the art.

Figure 4:
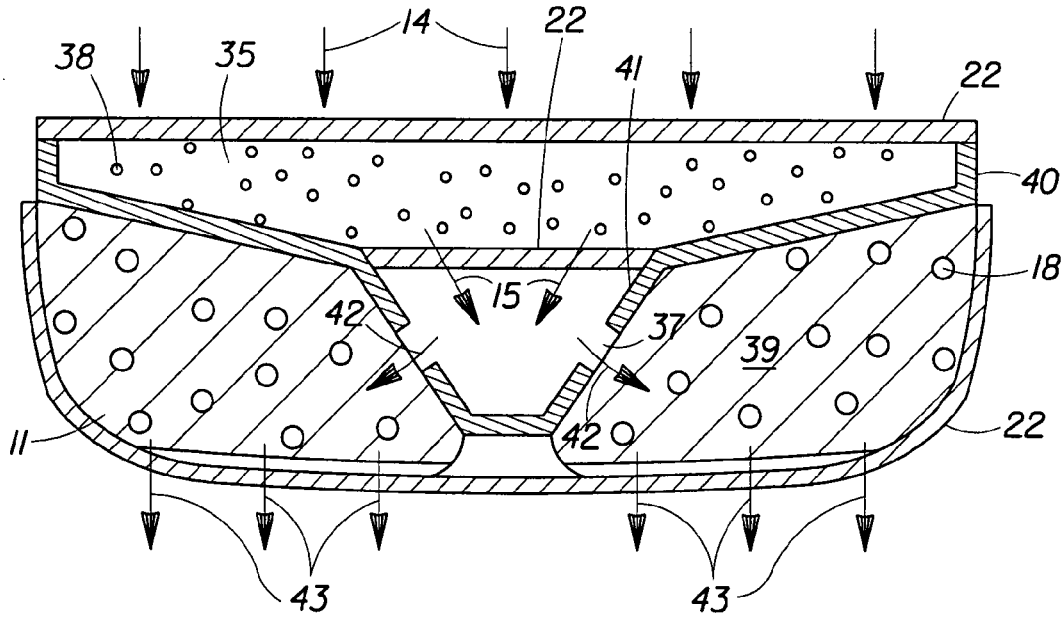
FIG. 4 is a cross sectional view of a unitary infusion pod according to the present invention wherein the liquid distribution member slopes down towards the injection nozzle allowing an extraction pod to be added with a substantially flat top.
Figure 5:
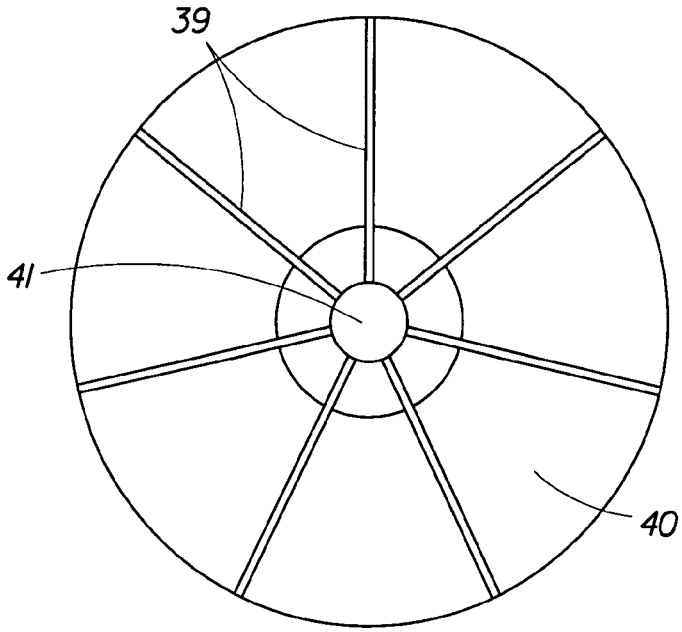
FIG. 5 is a bottom view of the fluid extraction member of FIG. 4, that is a view looking into the flow of liquid, showing the filter supporting baffles.
Figure 6:
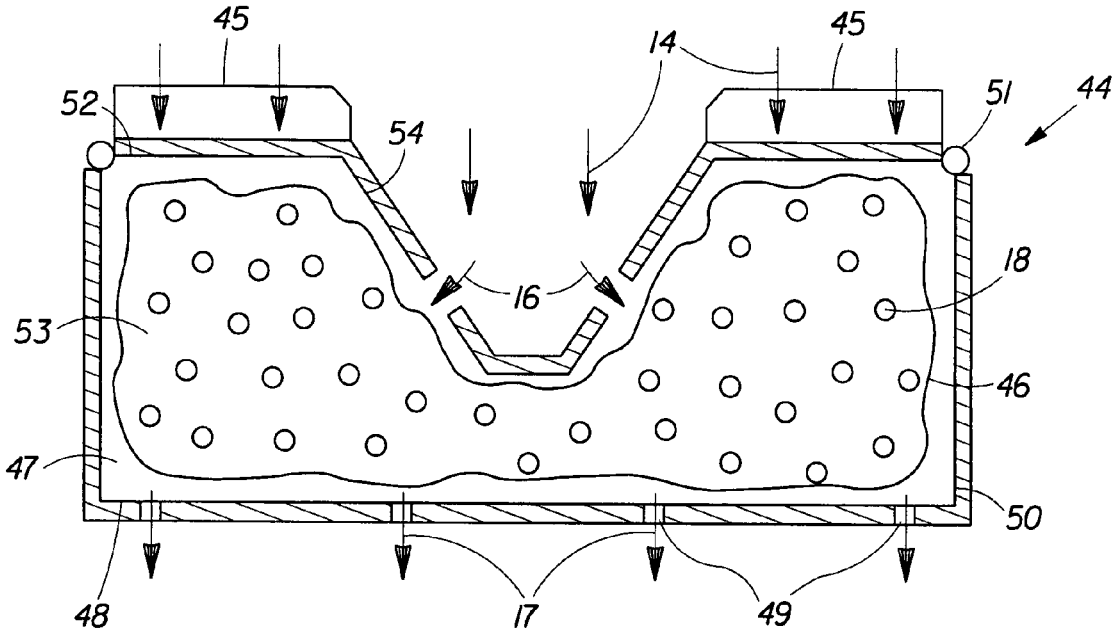
FIG. 6 is a cross sectional view of an infusion pod of the present invention that has a self contained filter pod within the infusion pod.

FIG. 4 shows yet another variation of the dual pod design wherein top filter member 31 is substantially adjacent and below the top plane TP. This configuration is made possible because fluid distribution member 40 slopes downward toward injection nozzle 41. As such, extractable material 38 is contained within the sloping portion of fluid distribution member 40. Once again, injection nozzle filter 33 is added to protect injection nozzle 41 and infusion ports 37 from being clogged with extractable material 38. Supporting baffles 39 are shown in FIG. 4 and FIG. 5. Supporting baffles 39 extend downward from fluid distribution member 40 to support and expand filter 22. These optional baffles can conform to filter 22 or can take a different shape depending on the desires of the pod designer. Likewise, as shown in FIG. 6 as supporting protrusions 45, supports can extend up from the fluid distribution member. Supporting protrusions 45 can be ribs, dimples, inverted channels, or another support structure, and are typically used to support an extraction pod above the infusion pod.

FIG. 6 illustrates yet another embodiment of the present invention wherein liquid infusion pod 44 comprises fluid distribution member 52 situated in a top plane TP. A liquid permeable first filter member is shown as infusion pod side walls 50, infusion pod bottom wall 48 and outlet ports 49. The first filter member is releaseably attached to fluid distribution member 52 at seal 51, forming a first interior chamber 47. Within first interior chamber 47 is a self contained, pre-dosed filter pod 46 having a second interior chamber 53 that comprises a liquid dispersible material 18. Fluid distribution member 52 comprises at least one injection nozzle 54 protruding downward from top plane TP into first interior chamber 47 without piercing the pre-dosed filter pod 46. Injection nozzle 54 has at least one infusion port 55 that directs high momentum fluid 16 into second interior chamber 53 in a direction that is not normal to the top plane. Post infusion liquid 17 exits infusion pod 44 via outlet ports 49.

Figure 7:
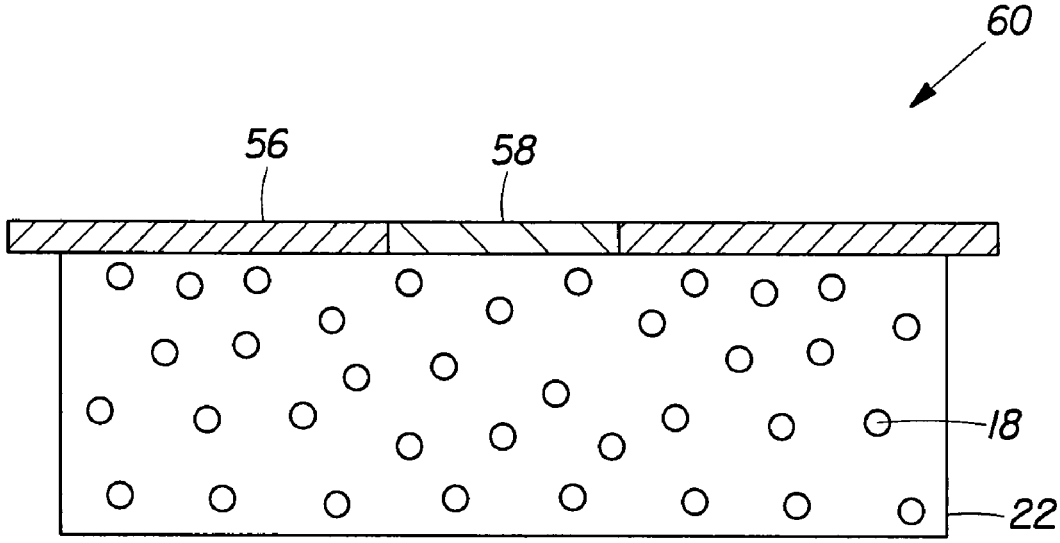
FIG. 7 is a cross sectional view of an infusion pod of the present invention that has a deflectable injection nozzle which is shown in its first, non-protruding position.
Figure 8:
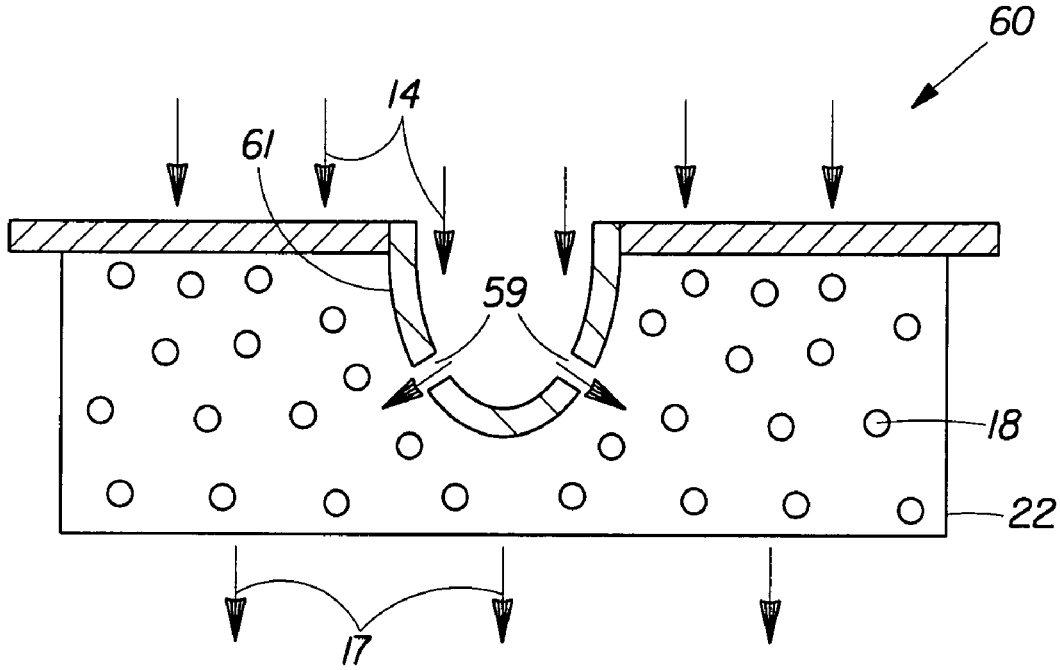
FIG. 8 is a cross sectional view of the infusion pod of FIG. 7 showing the deflectable injection nozzle in its second, protruding position.

Turning now to FIGS. 7 and 8 which show yet another embodiment of the present invention. Specifically, infusion pod 60 comprises a fluid distribution member 56 and filter member 22 that combine to house liquid dispersible material 18. Fluid distribution member 56 has at least one deflectable injection nozzle 58 having a first position that is substantially flush with the top plane TP as shown in FIG. 7. Deflectable injection nozzle 58 has a second position shown as deflected injection nozzle 61 in FIG. 8, wherein it is protruding downward from top plane TP into first interior chamber 57. Deflected injection nozzle 61 has at least one infusion port 59 that is open when in the second position, and wherein infusion port 59 directs high momentum fluid 16 into first interior chamber 57 in a direction that is not normal to top plane TP. Deflectable injection nozzle 58 moves from its first position to the second position due to the force of liquid 14.

Figure 9:
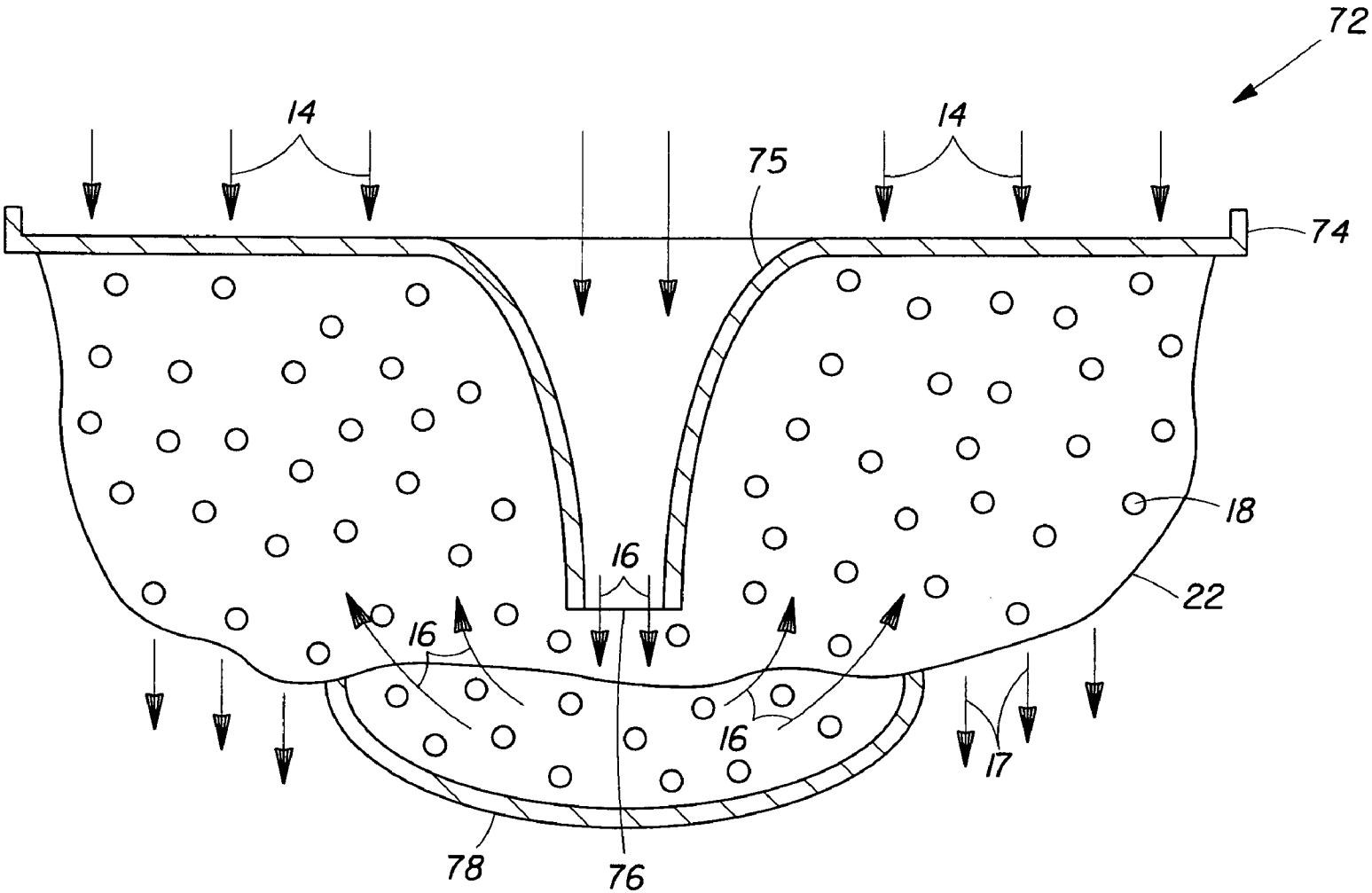
FIG. 9 is a cross sectional view of an infusion pod of the present invention that has a downward facing infusion nozzle and a deflection plate to change the direction of flow of the infusion liquid.

FIG. 9 illustrates a liquid infusion pod 72 comprising fluid distribution member 73 situated in top plane TP, and shown with optional end wall 74, and a liquid permeable first filter member 22. Filter member 22 is sealed to fluid distribution member 73 forming first interior chamber 11 that comprises liquid dispersible material 18. Fluid distribution member 73 comprises at least one injection nozzle 75 protruding downward from top plane TP into first interior chamber 11. Injection nozzle 75 has at least one infusion port 76 and at least one deflection plate 78. High momentum liquid 16 flows through infusion port 76 and is directed onto deflection plate 78 such that liquid 16 deflects off of deflection plate 78 into first interior chamber 11 in a direction that is not normal to the top plane TP. Post infusion liquid 17 ultimately exits pod 72 via filter member 22.

Figure 10:
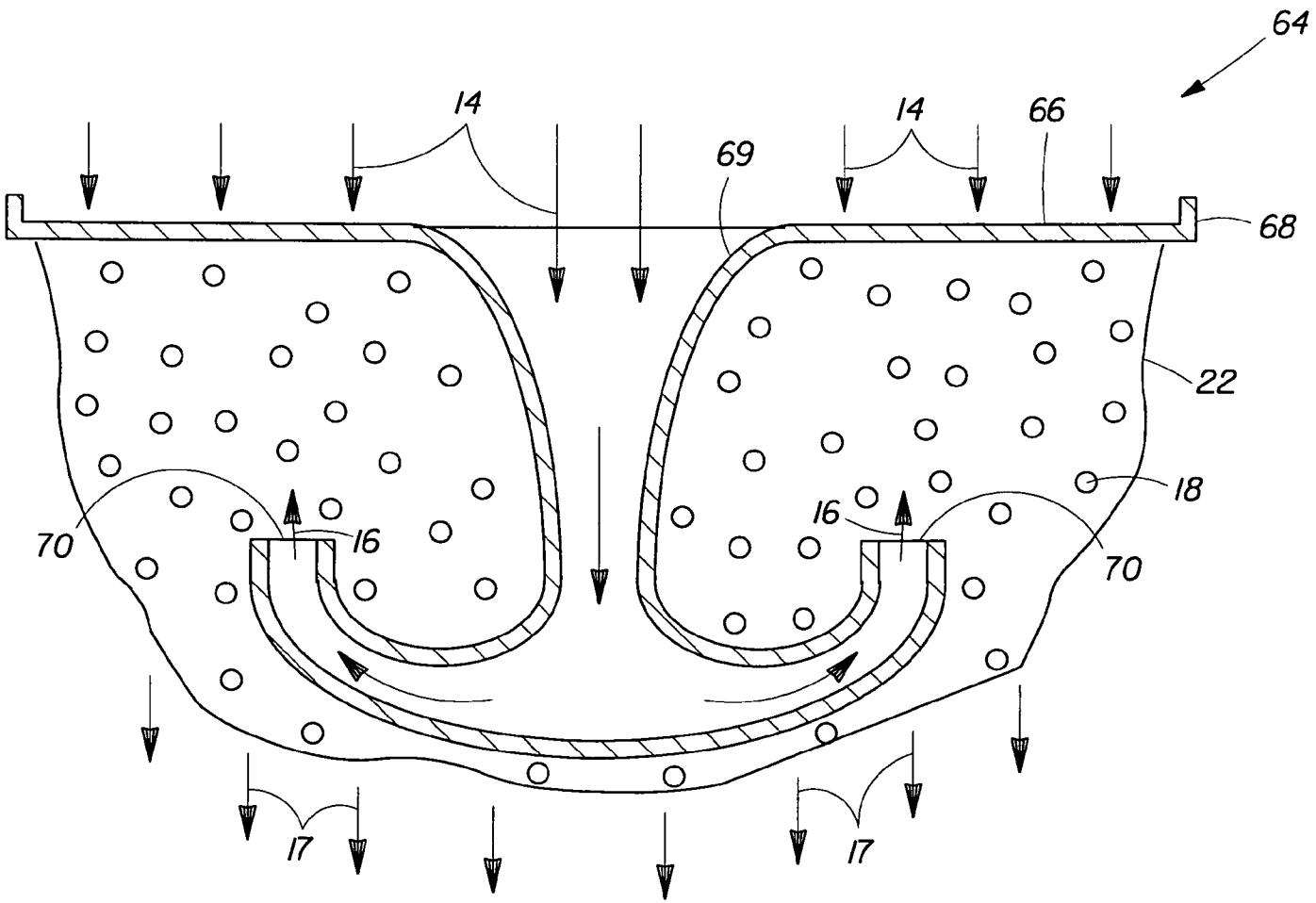
FIG. 10 is a cross sectional view of an infusion pod of the present invention that has upward facing infusion ports.

FIG. 10 illustrates yet another method of fluidizing a bed of liquid dispersible material 18. Specifically, infusion pod 64 comprises fluid distribution member 66, shown with optional end walls 68, having injection nozzle 69. Injection nozzle 69 comprises infusion ports 70 that redirect high momentum liquid 16 in a direction that is substantially normal to TP, but opposite the direction of flow for fresh liquid 14.

The forgoing embodiments of the present invention will be better understood with reference to the following description of the materials of construction, filter media, liquid dispersible materials, methods of using the present infusion pods and the example.

Material of Construction for Infusion Pods

In general, the infusion pods of the present invention can be made of any appropriate material. Materials for the filter members are discussed in greater detail below. It is understood, however, that the filter members defined herein must have some fluid permeability, while the fluid distribution member and the injection nozzle must be substantially liquid impermeable except for the infusion ports. By "substantially liquid impermeable" it is meant that at least about 90%, preferably at least about 95%, more preferably at least about 98%, by weight, of the liquid fed onto the liquid distribution member flows through the infusion ports into the first interior chamber.

The various parts the infusion pods can be comprised of rigid, semi-rigid, or non-rigid materials, including combinations thereof. The various parts of the present infusion pods may change their shape and/or rigidity, depending on the material selected and the given stage within the brewing process, see, for example, the injection nozzle 61 in FIGS. 7 and 8. Plastics, rubber, glass, treated paper, metals, semi rigid and rigid foams and the like are all suitable for use when making the pods of the present invention.

Filter Media

Filter members play an important role in the design of the present infusion pods. They may, however, be manufactured from any material that provides the necessary liquid permeability. Those skilled in the art will understand how to select and design appropriate filters based on the desired flow rates and the materials being filtered. The purpose of the filter media is to remove undesirable insoluble particles from the liquid before inclusion in a final beverage composition.

The filter media can be constructed from a variety of materials including, but not limited to, plastic, foil, non-woven polyester, polypropylene, polyethylene, paper materials, and combinations thereof. The filter media comprises one or more filtering orifices that allow the free passage of the post infusion liquid, while simultaneously preventing the passage of a significant amount (i.e., in excess of 90%) of unwanted insoluble particles and contaminants.

The filtering orifices may be formed in the filter media during creation of the filter media; inherent in the filter media material or combination of materials; formed as a result of one or more steps of the brewing process; or any combination thereof. For example, the filter media may be a continuous film, absent any filtering orifices during shipping and storage, and have the filtering orifices formed when the filter media contacts the infusion liquid. Alternatively, the filtering orifices may be formed in a continuous filter media by mechanical means applied to either side, such as piercing, tearing, puncturing, and combinations thereof. The orifices may also be formed by air pressure (e.g., blowing open or piercing the filter media material), water pressure, heat, lasers, electrical resistance, and the like.

As stated, the filtering orifices should be of sufficient size to allow the substantially unfettered passage of the post infusion liquid, while simultaneously preventing the passage of a significant amount (i.e., in excess of 90%) of unwanted insoluble particles. However, it is within the scope of the present invention that the orifices may have a variable geometry. This would depend on the force and/or pressure exerted against the portion of the filter media exposed to the extract solution, and the physical properties of the filter media material(s) selected (e.g., elasticity, tensile strength, and the like).

The filter media could be fashioned from one or more suitable filter media materials such that the filtering orifices would expand in size as pressure and/or force were applied. This would aide in the prevention of clogging, while simultaneously inhibiting the passage of a significant amount (i.e., in excess of 90%) of unacceptable particles and compounds.

Liquid Dispersible Materials

The infusion pods of this invention comprise a liquid dispersible material. Below are examples of these materials that are suitable for use in the present invention. Preferably, the liquid dispersible material is selected from the group consisting of dissolvable materials, liquid extractable materials, non-dissolvable materials and mixtures thereof. Further, the liquid dispersible material can be selected from the group consisting of solids, powders, granules, and mixtures thereof. Preferably the liquid dispersible material is selected from the group consisting of particles whose sizes are from about 100μ to 1 cm in diameter.

As used herein, "liquid" is intended to take on its broadest possible meaning. Water is the preferred liquid for use with the infusion pods of this invention, but milk, fruit juice and the like are acceptable. The liquid is preferably used at elevated temperatures, that is, greater than about 30° C., preferably greater than about 40° C. and more preferably greater than about 60° C. It is well known that liquids at elevated temperatures aid in extraction and dispersion processes as defined herein.

In certain embodiments of the present invention, there is provided a second filter member that is sealed to the fluid distribution member on the side opposite the first filter member defining a second interior chamber, which comprises a liquid extractable material. The liquid extractable material, for example, coffee grounds, tea leaves and the like, preferably comprises less than about 2%, more preferably less than about 1.5%, and even more preferably less than about 1.0%, by weight, of added materials selected from the group consisting of oils, fats, proteins and mixtures of these. It is understood that certain extractable materials, for example, coffee grounds, contain oils, but theses are not "added" oils as defined herein.

1) Fat/Oil

As used herein, the terms "fat" and "oils" are used interchangeably. Suitable oils for use in the compositions of the present invention include any edible oil. The oils can be comprised of completely saturated, partially saturated, unsaturated fatty acids or mixtures thereof. Preferred oils for use in the liquid dispersible materials herein include soybean oil, canola (low erucic acid) oil, corn oil, cottonseed oil, peanut oil, safflower oil, sunflower oil, rapeseed oil, sesame oil, olive oil, coconut oil, palm kernel oil, palm oil, tallow, butter, lard, fish oil, and mixtures thereof.

2) Protein

Suitable protein sources include plant, dairy, and other animal protein sources. Preferred proteins for preparing the liquid dispersible materials of the present invention include egg and milk proteins, plant proteins (including oilseed proteins obtained from cotton, palm, rape, safflower, cocoa, sunflower, sesame, soy, peanut, and the like), microbial proteins such as yeast proteins, so-called "single cell" proteins, and mixtures thereof. Preferred proteins also include dairy whey protein (including sweet dairy whey protein), and non-dairy proteins such as bovine serum albumin, egg white albumin, and vegetable whey proteins (i.e., non-dairy whey protein) such as soy protein. Especially preferred proteins for use in the present invention include whey proteins, such as β-lactoglobulins and α-lactalbumins; bovine serum albumins; egg proteins, such as ovalbumins; and, soy proteins, such as glycinin and conglycinin. Combinations of these especially preferred proteins are also acceptable for use in the present invention.

Preferred sources for protein particles herein include, but are not limited to, partially insoluble, partially denatured protein compositions such as Simplesse 100®, available from the CP-Kelco Company of San Diego, Calif. and DAIR-LO® from The Pfizer Company of New York, N.Y., both of which are whey proteins. Examples of these preferred protein sources are disclosed in U.S. Pat. No. 4,734,287 to Singer et al., issued Mar. 29, 1988; and U.S. Pat. No. 4,961,953 to Singer et al., issued Jun. 16, 1989, both of which are herein incorporated by reference. Especially preferred protein particle sources for use in the compositions of the present invention, and methods for making such protein particles sources, are disclosed in co-pending U.S. patent application Ser. No. 09/885,693, filed Jun. 22, 2001 to Francisco V. Villagran et al., which is herein incorporated by reference.

3) Carbohydrate Component

Suitable carbohydrates include, but are not limited to, LITA®, a mixture of Zein protein and gum arabic. See for example, U.S. Pat. No. 4,911,946 to Singer et al., issued Mar. 27, 1990; and U.S. Pat. No. 5,153,020 to Singer et al., issued Oct. 6, 1992, both of which are herein incorporated by reference. Other suitable carbohydrates include starches, gums and/or cellulose, as well as mixtures thereof. The starches are typically modified by cross-linking to prevent excessive swelling of the starch granules using methods well known to those skilled in the art. Additional suitable carbohydrates include calcium alginate, cross-linked alginates, dextran, gellan gum, curdlan, konjac mannan, chitin, schizophyllan and chitosan.

Preferred carbohydrate microparticles of the present invention are substantially non-aggregated. Aggregate blocking agents, for example, lecithin and xanthan gum, can be added to the carbohydrate microparticles to stabilize the particles. See U.S. Pat. No. 4,734,287 to Singer et al., issued Mar. 29, 1988, which is herein incorporated by reference.

Suitable carbohydrates for use in the liquid dispersible materials of the present invention may additionally include microcrystalline cellulose particles. The exact amount of the microcrystalline cellulose component, if one is included, is dependent on the nature of the specific beverage formulation desired and the remaining ingredients selected. Microcrystalline cellulose, which is also known in the art as "cellulose gel," is a non-fibrous form of cellulose that is prepared by partially depolymerizing cellulose obtained as a pulp from fibrous plant material with dilute mineral acid solutions. See U.S. Pat. No. 3,023,104, issued Feb. 27, 1962; U.S. Pat. No. 2,978,446; and U.S. Pat. No. 3,141,875, each of which is herein incorporated by reference, that disclose suitable methods of preparing the microcrystalline cellulose used herein. Suitable commercially available microcrystalline cellulose source include EMCOCEL®, from the Edward Mendell Co., Inc. and Avicel®, from FMC Corporation.

Suitable, microcrystalline cellulose sources may also be produced through a microbial fermentation process. Commercially available microcrystalline cellulose produced by a fermentation process includes PrimaCEL™, available from The Nutrasweet Kelco Company of Chicago, Ill.

4) Emulsifier

Emulsifiers of the type used herein help to disperse fat and oil in the food and beverage products comprising the liquid dispersible materials of the present invention. Any food grade emulsifier suitable for inclusion in edible products can be used. Examples of suitable emulsifiers include mono and diglycerides of long chain fatty acids, preferably saturated fatty acids, and most preferably, stearic and palmitic acid mono and diglycerides. Propylene glycol esters are also useful in these edible mixes. Lecithin is an especially preferred emulsifier in the liquid dispersible materials of the present invention. The emulsifier can be any food compatible emulsifier such as mono and diglycerides, lecithin, sucrose monoesters, polyglycerol esters, sorbitan esters, polyethoxylated glycerols and mixtures thereof.

Other suitable emulsifiers include lactylated mono and diglycerides, propylene glycol monoesters, polyglycerol esters, diacetylated tartaric acid esters of mono- and di-glycerides, citric acid esters of monoglycerides, stearoyl-2-lactylates, polysorbates, succinylated monoglycerides, acetylated monoglycerides, ethoxylated monoglycerides, lecithin, sucrose monoester, and mixtures thereof. Suitable emulsifiers include Dimodan® O, Dimodan® PV, and Panodan® FDP, manufactured by the Danisco Food Ingredients Company. The emulsifiers may optionally be utilized with a co-emulsifier. Depending on the particular formulation chosen, suitable co-emulsifiers may be chosen from any food compatible co-emulsifier or emulsifier. Particularly preferred emulsifier/co-emulsifier systems include Dimodan® O, Dimodan® PV, and Panodan® FDP.

A more detailed discussion of these preferred emulsifiers, including a description of the analytical methods used to test dispersibility can be found in co-pending U.S. patent application Ser. No. 09/965,113, filed Sep. 26, 2001 to Lin et al., herein incorporated by reference.

5) Bulking Agents

Bulking agents are defined herein as those ingredients that do not substantially contribute to the overall mouthfeel, texture, or taste of the powdered and liquid, dairy and non-dairy liquid dispersible materials of the present invention. The primary purpose of bulking agents is to control the overall concentration of solids in solution.

Suitable bulking agents are selected from the group consisting of corn syrup solids, maltodextrin and various dextrose equivalents, starches, and mixtures thereof. Corn syrup solids are particularly preferred bulking agents because of their cost and processability.

6) Milk Solids

The liquid dispersible materials of the present invention may optionally comprise non-microparticulated dairy proteins (e.g., milk solids). These milk solids can be prepared by drying milk to produce a mixture of the proteins, minerals, whey and other components of milk in a dry form. The milk solids may include butterfat solids and cream powder, and preferably include low-fat dry milk and non-fat milk solids. Especially preferred milk solids are those milk solids derived from milk that has had the fat removed.

Suitable milk solids for use in the present invention can be derived from a variety of commercial sources. Dry mixes typically used to prepare ice cream, milk-shakes, and frozen desserts may also be included in the liquid dispersible materials herein. These dry mixes provide an especially creamy, rich mouthfeel to the liquid dispersible material when the liquid dispersible materials of the present invention are mixed with water or other beverage or food product.

7) Soluble Beverage Components

The liquid dispersible materials of the present invention may optionally comprise soluble beverage components. Suitable soluble beverage components are readily available to, and can be easily chosen by, one having ordinary skill in the art. Soluble beverage components include, but are not limited to, coffee, tea, juice, and mixtures thereof. The soluble beverage components may be in liquid, solid concentrate, powder, extract, or emulsion form.

The preferred soluble beverage component for use in a given flavored beverage product containing the liquid dispersible materials of the present invention is determined by the particular application of the liquid dispersible material product. For example, if the final application is intended to be a coffee beverage, the soluble beverage component is, generally, coffee. For a tea or juice beverage product, the soluble beverage component is generally, tea or juice, respectively.

Suitable soluble coffee components, for use in a given flavored beverage product containing the liquid dispersible materials of the present invention, can be prepared by any convenient process. A variety of such processes are known to those skilled in the art. Typically, soluble coffee is prepared by roasting and grinding a blend of coffee beans, extracting the roast and ground coffee with water to form an aqueous coffee extract, and drying the extract to form instant coffee. Soluble coffee useful in the present invention is typically obtained by conventional spray drying processes.

Representative spray drying processes that can provide suitable soluble coffee are disclosed in, for example, pages 382-513 of Sivetz & Foote, COFFEE PROCESSING TECHNOLOGY, Vol. I (Avi Publishing Co. 1963); U.S. Pat. No. 2,771,343 (Chase et al), issued Nov. 20, 1956; U.S. Pat. No. 2,750,998 (Moore), issued Jun. 19, 1956; and U.S. Pat. No. 2,469,553 (Hall), issued May 10, 1949, each of which is incorporated herein by reference. Other suitable processes for providing instant coffee for use in the present invention are disclosed in, for example, U.S. Pat. No. 3,436,227 (Bergeron et al), issued Apr. 1, 1969; U.S. Pat. No. 3,493,388 (Hair), issued Feb. 3, 1970; U.S. Pat. No. 3,615,669 (Hair et al), issued Oct. 26, 1971; U.S. Pat. No. 3,620,756, (Strobel et al), issued Nov. 16, 1971; U.S. Pat. No. 3,652,293 (Lombana et al), issued Mar. 28, 1972, each of which is incorporated herein by reference.

In addition to spray dried instant coffee powders, instant coffee useful in the present invention can include freeze-dried coffee. The instant coffee can be prepared from any single variety of coffees or a blend of different varieties. The instant coffee can be decaffeinated or undecaffeinated and can be processed to reflect a unique flavor characteristic such as espresso, French roast, or the like.

8) Buffers

The liquid dispersible materials of the present invention may optionally comprise a buffering system. Suitable buffering systems for use herein are capable of maintaining the pH value of the finished, ready to consume beverage product including the present liquid dispersible materials in the range of from about 5.5 to about 7.2. Preferred buffering systems comprise stabilizing salts capable of improving the colloidal solubility of proteins and simultaneously maintaining the pH value of a beverage in the range of from about 5.5 to 7.2, in order to achieve optimum stability and flavor.

Preferred stabilizing salts include the disodium and/or dipotassium salts of citric acid and/or phosphoric acid. The use of phosphate salts is particularly desirable when the water used for the preparation of the beverage is high in calcium or magnesium.

Suitable buffering systems for use in the liquid dispersible materials of the present invention may also be combined with flavor profile mimicking, matching, manipulation and/or adjustment systems comprising various taste contributing acids and bases. Especially preferred flavor profile mimicking, matching, manipulation and/or adjustment systems for use in the present invention are disclosed in co-pending U.S. patent application Ser. No. 10/074,851, filed Feb. 13, 2002 to Hardesty et al., which is incorporated herein by reference.

9) Thickeners

The liquid dispersible materials of the present invention may optionally comprise one or more thickening agents. As used herein, the term "thickening agent" includes natural and synthetic gums, and natural and chemically modified starches. It is preferred that the thickening agents of the present invention be comprised predominately of starches, and that no more than 20%, preferably no more than 10%, of the thickener be comprised of gums.

Suitable starches for use herein include, but are not limited to, pregelatinized starch (corn, wheat, tapioca), pregelatinized high amylose content starch, pregelatinized hydrolyzed starches (maltodextrins, corn syrup solids), chemically modified starches such as pregelatinized substituted starches (e.g., octenyl succinate modified starches such as N-Creamer®, N-Lite LP®, and TEXTRA®, manufactured by the National Starch Company), as well as mixtures of these starches. Suitable gums for use herein include locust bean gum, guar gum, gellan gum, xanthan gum, gum ghatti, modified gum ghatti, tragacanth gum, carrageenan, and/or anionic polymers derived from cellulose such as carboxymethylcellulose, sodium carboxymethylcellulose, as well as mixtures of these gums.

10) Foaming Agents

The liquid dispersible materials of the present invention may optionally comprise foaming agents and/or a foaming system for generating consumer preferred amounts of foam in a finished beverage product comprising the present liquid dispersible materials. Suitable foaming systems for use in the present invention include any compound, or combination of compounds, capable of rendering a desired foam head, of a given height and density, in the finished beverage product. Preferred foaming systems for use herein comprise an acid ingredient and a carbonate and/or bicarbonate ingredient, that when allowed to react together generate foam.

As used herein, the term "acid ingredient" refers to an edible, water-soluble, organic or inorganic acid. Preferred acids include, but are not limited to, citric acid, malic acid, tartaric acid, fumaric acid, succinic acid, phosphoric acid, as well as mixtures of these acids. As used herein, the term "Carbonate" and "Bicarbonate" refer to an edible, water-soluble carbonate or bicarbonate salt that evolves carbon dioxide when it reacts with the acid ingredient. Preferred carbonate and bicarbonate salts include, but are not limited to, sodium bicarbonate, sodium carbonate, potassium bicarbonate, potassium bicarbonate, as well as any mixture thereof. Mixtures of sodium carbonate and sodium bicarbonate are especially preferred when used in combination with citric acid.

The foaming agents and/or foaming systems may optionally comprise one or more foam stabilizing ingredients. Suitable proteinaceous foam stabilizers include non-microparticulated egg white albumin (ovalbumin), whey protein, soy protein, soy protein isolate, corn protein isolate, as well as mixtures of these stabilizers. Non-microparticulated dried egg white albumin is particularly preferred because of its ability to form stable foams at relatively low concentrations.

11) Sweeteners

The liquid dispersible materials of the present invention may optionally comprise one or more sweeteners. Preferred sweeteners for use in the present invention include, but are not limited to, sugars and sugar alcohols such as sucrose, fructose, dextrose, maltose, lactose, high fructose corn syrup solids, invert sugar, sugar alcohols, including sorbitol, as well as mixtures of these sugars and sugar alcohols.

In embodiments of the present invention where it is preferable to deliver lower levels of solids per dosage, it is particularly preferred to use a higher intensity sweetener with the sugar or sugar alcohol. These higher intensity sweeteners include saccharin; cyclamates; acesulfame K; L-aspartyl-L-phenylalanine lower alkyl ester sweeteners (e.g., aspartame); L-aspartyl-D-alanine amides, disclosed in U.S. Pat. No. 4,411,925 to Brennan et al.; L-aspartyl-D-serine amides, disclosed in U.S. Pat. No. 4,399,163 to Brennan et al; L-aspartyl-L-1-hydroxymethylalkaneamide sweeteners, disclosed in U.S. Pat. No. 4,338,346 to Brand et al.; L-aspartyl-1-hydroxyethyalkaneamide sweeteners, disclosed in U.S. Pat. No. 4,423,029 to Rizzi; and L-aspartyl-D-phenylglycine ester and amide sweeteners, disclosed in European Patent Application 168,112 to J. M. Janusz, published Jan. 15, 1986. Mixtures of the high intensity sweeteners disclosed herein, as well as mixtures of the high intensity sweeteners and sugars and sugar alcohols, are equally suitable for use in the liquid dispersible materials of the present invention.

A particularly preferred sweetener system is a combination of sucrose with aspartame and acesulfame K. This mixture not only enhances sweetness, but also lowers the level of solids that is required in preparing the food and beverage products comprising the present liquid dispersible material.

12) Processing Aids

The liquid dispersible materials of the present invention may optionally comprise processing aids, including flow aids, anti-caking agents, dispersing aids, and the like. Preferred processing aides include, but are not limited to, flow aids such as silicon dioxide and silica aluminates. Starches, aside from the thickening agents, can also be included to keep the various ingredients from caking.

13) Flavorants

The liquid dispersible materials of the present invention may optionally comprise one or more flavorants used to deliver one or more specific flavor impacts. Preferred flavors of the type used herein are typically obtained from encapsulated and/or liquid flavorants. These flavorants can be natural or artificial in origin. Preferred flavors, or mixtures of flavor, include almond nut, amaretto, anisette, brandy, cappuccino, mint, cinnamon, cinnamon almond, creme de menthe, Grand Mariner, peppermint stick, pistachio, sambuca, apple, chamomile, cinnamon spice, creme, creme de menthe, vanilla, French vanilla, Irish creme, Kahlua, mint, peppermint, lemon, macadamia nut, orange, orange leaf, peach, strawberry, grape, raspberry, cherry, coffee, chocolate, cocoa, mocha and the like, and mixtures thereof. The liquid dispersible materials of the present invention may also comprise aroma enhancers such as acetaldehyde, herbs, spices, as well as mixtures thereof.

Methods of Using the Infusion Pods

Figure 12:
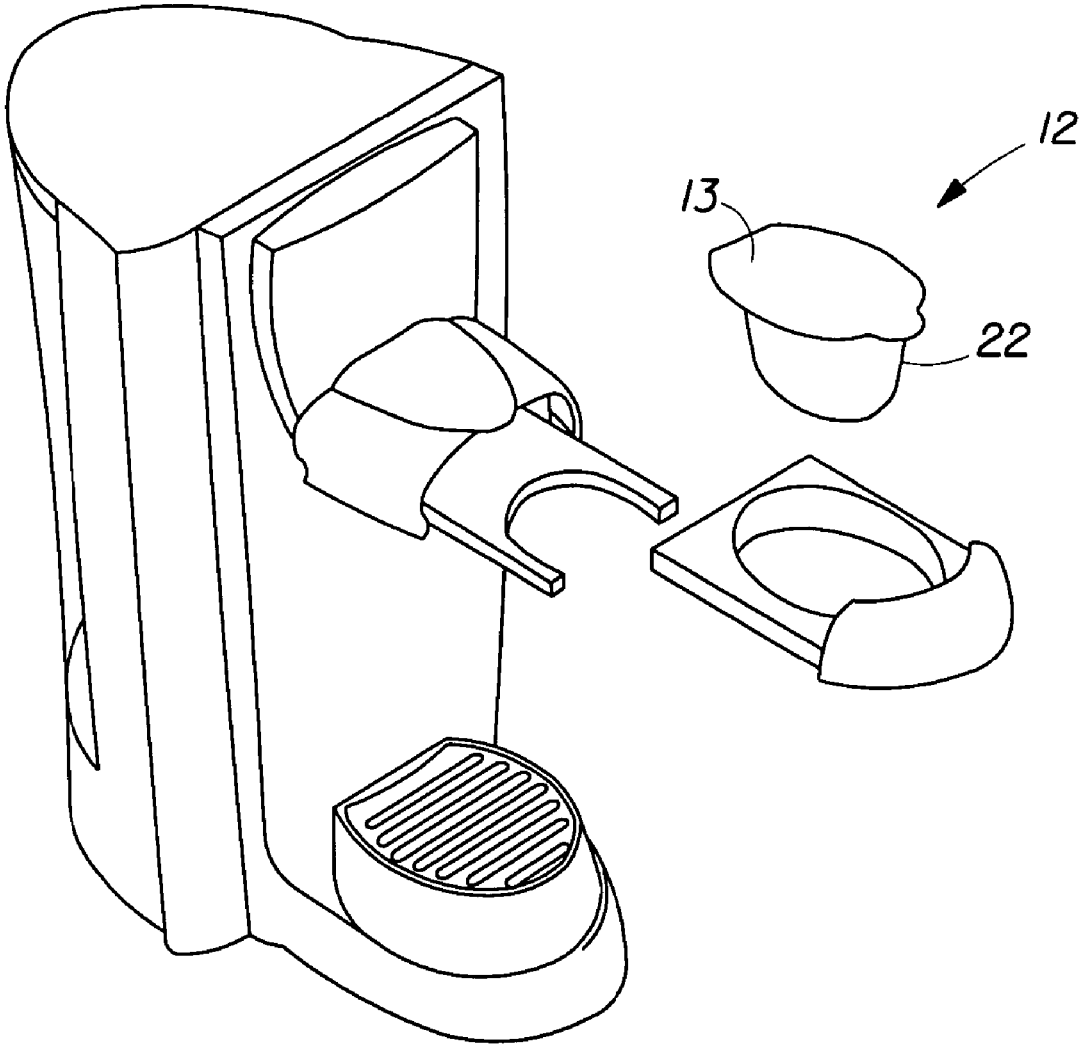
FIG. 12 is a brewer suitable for use with the infusion pods of the present invention.

The use of the infusion pods of the present invention is best understood with reference to FIG. 12 which shows infusion brewer 200. Infusion pod 12 is shown with protective cover 13 which must be removed before infusion pod 12 can be used. Filter member 22 is shown below protective cover 13. Infusion pod 12 fits into receiving tray 210 which then slides into tray receptacle 214. Infusion liquid 215 is charged into liquid receptacle 216 and mug 212 is placed under tray receptacle 214. Infusion liquid 215, which is preferably water, is heated and pressurized within brewer 200 and then injected into infusion pod 12. The heated liquid is preferably pressurized to at least about 10 psig, more preferably at least about 15 psig, and even more preferably at least about 20 psig. The heated and pressurized liquid flows through infusion pod 12 as described in detail above, and a tasty infusion beverage flows out of filter member 22 into mug 212. Preferred beverage preparation times are less than about 120 seconds, more preferably less than about 90 seconds, more preferably less than about 75 seconds, more preferably less than 60 seconds.

Example 1

The following example further describes and demonstrates a liquid dispersible material suitable for use in the infusion pods of the present invention. This example is given solely for the purpose of illustration and is not to be construed as a limitation of the present invention, as many variations thereof are possible without departing from the invention's spirit and scope.

A liquid dispersible material is prepared from the ingredients and in the amounts presented in Table 1:

TABLE 1

| | Percentage of Ingredient Component | Dry weight percentage of total formula |
|---|---|---|
| Microparticulated Ingredient Component | | |
| i) Fat/Oil Component | | |
| Coconut Oil | 38.46% | 25% |
| Canola Oil | 38.46% | 25% |
| ii) Protein Component | | |
| Microparticulated Whey Protein | 23.08% | 15% |

TABLE 1-continued

| | Percentage of Ingredient Component | Dry weight percentage of total formula |
|---|---|---|
| Secondary Ingredient Component | | |
| i) Emulsifier | | |
| Sodium Caseinate | 5.7% | 2% |
| Mono and Diglycerides | 2.85% | 1% |
| ii) Bulking Agent | | |
| Corn Syrup Solids | 91.45% | 32% |
| | Total | 100% |

A 100 g sample of the liquid dispersible material of Table 1 is prepared by first heating the Coconut and Canola Oil to about 200° F. in a 400 ml Pyrex beaker. The temperature is selected to ensure that the fat/oil component is completely liquefied. The temperature is maintained at about 200° F. and 50 ml of water is added to the liquefied oil. Agitation is applied to the liquefied oil/water mixture using an IKA high shear mixer (available from the IKA-Werke Company of Germany). The IKA mixer is set on a No. 6 speed setting.

The microparticulated whey protein is added to the liquefied oil/water mixture in the continued presence of agitation. The sodium caseinate and the mono- and di-glycerides are added and agitation is continued for approximately 5 minutes. The corn syrup solids are added and agitation is continued until all dry ingredients are thoroughly wetted, approximately 5 minutes.

The resulting mixture is then homogenized using an APV Gaulin Model15MR Homogenizer (available from the APV Gaulin Company of Denmark). The homogenizer is run at a first stage setting of 500 psi and a second stage setting 2000 psi. The resulting homogenized composition is dried to a free moisture content of about 3% utilizing an Yamato countercurrent bench top spray dryer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid infusion pod comprising a liquid permeable fluid distribution member situated in a top plane and a liquid permeable first filter member wherein the first filter member is engaged to the fluid distribution member forming a first interior chamber that comprises a liquid dispersible material, the fluid distribution member comprising at least one injection nozzle having a first position that is substantially flush with the top plane and the injection nozzle having a second position wherein it is protruding downward from the top plane into the first interior chamber, the injection nozzle having at least one infusion port that is open when in the second position and wherein the infusion port directs fluid into the first interior chamber in a direction that is not normal to the top plane.

2. The pod of claim 1 wherein the liquid dispersible material is substantially dry and comprises at least one of a fat containing material, a protein containing material and mixtures thereof.

3. The pod of claim 1 wherein the surface area of the infusion port is small enough that water will flow through the infusion port with a linear velocity of at least about 25 cm/second under a pressure of about 1.5 atmospheres or more.

4. The pod of claim 1 wherein the fluid distribution member and the injection nozzle are substantially liquid impermeable except for the infusion port, wherein "substantially liquid impermeable" means that at least about 90%, by weight, of the liquid fed onto the liquid distribution member flows through the infusion port into the first interior chamber.

5. The pod of claim 1 wherein the injection nozzle is substantially rigid.

6. The pod of claim 1 wherein the fluid distribution member slopes downward away from the top plane towards the injection nozzle.

7. The pod of claim 1 wherein the liquid dispersible material is selected from the group consisting of solids, powders, granules, dissolvable materials, liquid extractable materials, non-dissolvable materials and mixtures thereof, wherein the liquid dispersible material comprises particles whose sizes are from about 100 μm to 1 cm in diameter.

8. The pod of claim 1 wherein the injection nozzle penetrates the infusion pod by at least about 20% of the distance measured from the top plane to the bottom most portion of the first filter member.

9. The pod of claim 1 wherein the at least one infusion port is located within the range of from about 20% to about 100% of the distance of penetration of the injection nozzle.

10. The pod of claim 1 wherein the at least one infusion port that is not normal to the top plane directs water from the injection nozzle at an angle of from about 20° to about 160° from the point of the infusion port on a line normal to the top plane.

11. The pod of claim 1 wherein the liquid dispersible material is selected from the group consisting of solids, powders, granules, dissolvable materials, liquid extractable materials, non-dissolvable materials and mixtures thereof, wherein the liquid dispersible material comprises particles whose sizes are from about 100 μm to 1 cm in diameter.

12. A liquid infusion pod comprising a liquid permeable fluid distribution member situated in a top plane and a liquid permeable first filter member wherein the filter member is engaged to the fluid distribution member forming a first interior chamber that comprises a liquid dispersible material, the fluid distribution member comprising at least one injection nozzle protruding downward from the top plane into the first interior chamber, the injection nozzle has at least one infusion port and at least one deflection plate wherein liquid flows through the infusion port and is directed onto the deflection plate such that the fluid deflects off of the deflection plate into the first interior chamber in a direction that is not normal to the top plane.

13. The pod of claim 12 wherein the liquid dispersible material is substantially dry and comprises at least one of a fat containing material, a protein containing material and mixtures thereof.

14. The pod of claim 12 wherein the surface area of the infusion port is small enough that water will flow through the infusion port with a linear velocity of at least about 25 cm/second under a pressure of about 1.5 atmospheres or more.

15. The pod of claim 12 wherein the fluid distribution member and the injection nozzle are substantially liquid impermeable except for the infusion port, wherein "substantially liquid impermeable" means that at least about 90%, by weight, of the liquid fed onto the liquid distribution member flows through the infusion port into the first interior chamber.

16. The pod of claim 12 wherein the injection nozzle is substantially rigid.

17. The pod of claim 12 wherein the fluid distribution member slopes downward away from the top plane towards the injection nozzle.

18. The pod of claim 12 wherein the injection nozzle penetrates the infusion pod by at least about 20% of the distance measured from the top plane to the bottom most portion of the first filter member.

19. The pod of claim 12 wherein the at least one infusion port is located within the range of from about 20% to about 100% of the distance of penetration of the injection nozzle.

20. The pod of claim 12 wherein the at least one infusion port that is not normal to the top plane directs water from the injection nozzle at an angle of from about 20° to about 160° from the point of the infusion port on a line normal to the top plane.

* * * * *